US009033051B1

(12) United States Patent
Lugo

(10) Patent No.: US 9,033,051 B1
(45) Date of Patent: May 19, 2015

(54) SYSTEM FOR DIVERSION OF FLUID FLOW FROM A WELLHEAD

(71) Applicant: Mario R. Lugo, Houston, TX (US)

(72) Inventor: Mario R. Lugo, Houston, TX (US)

(73) Assignee: TRENDSETTER ENGINEERING, INC., Houston, TX (US)

( * ) Notice: Subject to any disclaimer, the term of this patent is extended or adjusted under 35 U.S.C. 154(b) by 0 days.

(21) Appl. No.: 14/152,591

(22) Filed: Jan. 10, 2014

Related U.S. Application Data

(63) Continuation-in-part of application No. 13/269,769, filed on Oct. 10, 2011, now Pat. No. 8,720,580, which is a continuation-in-part of application No. 13/160,032, filed on Jun. 14, 2011.

(51) Int. Cl.

| | |
|---|---|
| ***E21B 43/01*** | (2006.01) |
| ***E21B 33/06*** | (2006.01) |
| ***E21B 33/076*** | (2006.01) |
| ***E21B 33/064*** | (2006.01) |

(52) U.S. Cl.
CPC ..... *E21B 33/064* (2013.01); *E21B 33/06* (2013.01); *E21B 43/0122* (2013.01)

(58) Field of Classification Search
CPC . E21B 43/0122; E21B 43/0105; E21B 33/06; E21B 33/064
USPC ..... 166/344, 345, 363, 364, 338, 347, 367, 166/368; 251/1.1
See application file for complete search history.

(56) References Cited

U.S. PATENT DOCUMENTS

| | | | | |
|---|---|---|---|---|
| 3,301,322 | A * | 1/1967 | Newsome | 166/339 |
| 3,602,299 | A * | 8/1971 | Mozic | 166/351 |
| 3,635,347 | A * | 1/1972 | Rupnick | 210/242.3 |
| 3,881,549 | A * | 5/1975 | Thomas | 166/357 |
| 4,324,505 | A | 4/1982 | Hammett | |
| 4,405,258 | A | 9/1983 | O'Rourke et al. | |
| 4,444,250 | A | 4/1984 | Keithahn et al. | |
| 4,502,534 | A | 3/1985 | Roche et al. | |
| 4,597,447 | A * | 7/1986 | Roche et al. | 166/347 |
| 4,646,844 | A | 3/1987 | Roche et al. | |
| 4,828,024 | A | 5/1989 | Roche | |
| 5,323,860 | A | 6/1994 | Watkins | |
| 5,984,012 | A | 11/1999 | Wactor et al. | |
| 7,165,619 | B2 | 1/2007 | Fox et al. | |
| 7,597,811 | B2 | 10/2009 | Usher | |
| 7,921,917 | B2 * | 4/2011 | Kotrla et al. | 166/339 |
| 2004/0099420 | A1 * | 5/2004 | Kotrla et al. | 166/345 |
| 2009/0095464 | A1 | 4/2009 | McGrath et al. | |
| 2009/0260829 | A1 | 10/2009 | Mathis | |
| 2012/0001100 | A1 * | 1/2012 | Hubbell, Jr. | 251/1.1 |
| 2012/0018165 | A1 * | 1/2012 | Crossley et al. | 166/344 |
| 2012/0121335 | A1 * | 5/2012 | Fedotov et al. | 405/64 |
| 2012/0211234 | A1 * | 8/2012 | Wilie et al. | 166/345 |

* cited by examiner

*Primary Examiner* — James G Sayre
(74) *Attorney, Agent, or Firm* — Egbert Law Offices, PLLC

(57) ABSTRACT

A system for the diversion of flow from a wellhead has a mudline closure mechanism suitable for attachment to the wellhead, a blowout preventer connected or interconnected to the mudline control mechanism, and a flow control line having one end connected to a diversion passageway of the mudline control mechanism and extending therefrom such that an opposite end of the flow control line is disposed away from the mudline closure mechanism. The mudline closure mechanism has a main passageway communicating with the flow passageway of the blowout preventer. The mudline closure mechanism has a valve suitable for switching fluid flow from the main passageway to the diversion passageway. The blowout preventer is positioned above the mudline closure mechanism. The flow control line is supported by a base anchored into the subsea floor away from the mudline closure mechanism.

13 Claims, 3 Drawing Sheets

SYSTEM FOR DIVERSION OF FLUID FLOW FROM A WELLHEAD

CROSS-REFERENCE TO RELATED APPLICATIONS

The present application is a continuation-in-part of U.S. patent application Ser. No. 13/269,769 filed on Oct. 10, 2011, and entitled "System and Method for Diverting Fluids from a Damaged Blowout Preventer", presently pending. U.S. patent application Ser. No. 13/269,769, is a continuation-in-part of U.S. patent application Ser. No. 13/160,032, filed on Jun. 14, 2011, and entitled "Diverter System for a Subsea Well", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to subsea oil and gas production. More particularly, the present invention relates to systems and methods whereby a flow of fluid from the wellhead can be diverted in a direction away from a blowout preventer. Additionally, the present invention relates to systems whereby the boiling effects of high pressure hydrocarbon releases are transferred to a location away from the oil platform and/or blowout preventer.

2. Description of Related Art Including Information Disclosed Under 37 CFR 1.97 and 37 CFR 1.98

As the worldwide demand for hydrocarbon fuel has increased, and known onshore reserves have not kept up with the demand, there has been increasing activity in offshore oil exploration and production. Reserves of oil known to exist in the offshore areas have steadily increased and an increasing percentage of world production is from these offshore areas. The offshore environment has presented numerous new challenges to the oil drilling industry which have been steadily overcome to allow efficient drilling and production in these areas, although the costs have been considerably higher than those of onshore operations.

Not only has the offshore environment made production more difficult to accomplish, it has also generally increased the risk of environmental damage in the event of a well blowout or other uncontrolled loss of hydrocarbons into the sea. As a result, known safety equipment, such as blowout preventers which have been used successfully in onshore operations, have been used in offshore operations also. In spite of safety precautions, blowouts of offshore oil wells are known to occur and will occur in the future.

Subsea drilling operations may experience a blowout, which is an uncontrolled flow of formation fluids into the drilling well. These blowouts are dangerous and costly, and can cause loss of life, pollution, damage to drilling equipment, and loss of well production. To prevent blowouts, blowout prevention equipment is required. This blowout prevention equipment typically includes a series of equipment capable of safely isolating and controlling the formation pressures and fluids at the drilling site. BOP functions include opening and closing hydraulically-operated pipe rams, annular seals, shear rams designed to cut the pipe, a series of remote-operated valves to allow control the flow of drilling fluids, and well re-entry equipment. In addition, process and condition monitoring devices complete the BOP system. The drilling industry refers to the BOP system as the BOP stack.

The well and the BOP connect the surface drilling vessel to a marine riser pipe, which carries formation fluids (e.g., oil, gas, etc.) to the surface and circulates drilling fluids. The marine riser pipe connects to the BOP through the Lower Main Riser Package (LMRP) which contains a device to connect to the BOP, an annular seal for well control, and flow control devices to supply hydraulic fluids for the operation of the BOP. The LMRP and the BOP are commonly referred to, collectively, as simply the BOP. Many BOP functions are hydraulically controlled, with piping attached to the riser supplying hydraulic fluids and other well control fluids. Typically, a central control unit allows an operator to monitor and control the BOP functions from the surface. The central control unit includes a hydraulic control system for controlling the various BOP functions, each of which has various flow control components upstream of it.

While many of the techniques used in onshore operations can be applied in the offshore environment, they often prove to be less effective and require a much longer time period for implementation. For example, while relief wells can drilled to intercept the blowout well, a great amount of time may be required in the drilling operation. In drilling the relief wells, platforms or other drilling support decks must be located and transported to the blowout site before drilling operations can begin. Due to the rugged offshore environment, more time is required to drill the relief wells than would be required in onshore operations. As a result of all of these difficulties, many months can pass between the occurrence of an offshore oil well blowout and the successful final capping of the blown-out well. In the intervening time, large quantities of oil and gas can escape into the ocean with serious environmental impact.

While a portion of the hydrocarbons lost from a subsea well blowout may be trapped and skimmed by various containment booms and oil skimmer ships, substantial quantities of hydrocarbons can still escape such containment equipment. It can be seen that once the hydrocarbons are allowed to reach the ocean, surface wave action tends to disperse the lighter hydrocarbons which may mix with water or evaporate into the air. The gaseous hydrocarbons, of course, tend to escape into the atmosphere. The heavier ends of the crude oil often form into globules or tar balls which may flow at, or just below, the water's surface so as to make it difficult to contain or to skim up.

One of the problems associated with diverter systems for such blowout preventers is that, under certain circumstances, the pressure of the fluid released from the blowout preventer is of extremely high pressures, up to 15,000 p.s.i. Under such circumstances, if there is a release from the blowout preventer, or from the wellhead, these extreme pressure will cause boiling and turbulence in the water directly above the blowout preventer and/or wellhead. This boiling of hydrocarbons in the water directly adjacent to the oil platform is extremely hazardous. First, the amount of turbulence caused by such boiling makes it extremely difficult to carry out further repair activities. Under other circumstances, the presence of such hydrocarbons on the top of the water will create an extreme fire and explosion hazard. As such, it is extremely important so as to avoid the release of hydrocarbons from the subsea well such that the boiling action of the released hydrocarbons is diverted away from the offshore platform or from marine vessels associated therewith.

Recently, there been new developments in the production of oil and gas in which flexible risers have extended from a blowout preventer located at the surface of the water to the wellhead. As such, the blowout preventer will actually be positioned a significant distance above the wellhead. It is important, under such circumstances, that proper connections are achieved between the riser and the wellhead. Typically, the blowout preventer will be supported on an offshore platform or upon a drilling ship. As such, need has developed so as to create a fail-safe mechanism whereby if there is a problem with the connection between the flexible riser in the wellhead, fluid flow can be diverted prior to reaching the blowout preventer. In other circumstances, if the blowout preventer should prove to be defective or inadequate for controlling the flow of hydrocarbons, it is important to provide a back-up or safety system whereby the fluids can be diverted prior to reaching the blowout preventer.

In the past, various patents and patent publications have issued relating to systems for the containment of oil spills and blowouts. For example, U.S. Pat. No. 4,324,505, issued on Apr. 13, 1982 to D. S. Hammett, discloses a subsea blowout containment method and apparatus. This blowout containment apparatus comprises an inverted funnel adapted for positioning over a wellhead to receive fluids from the well and direct them into a conduit extending from the funnel to surface support and processing equipment. The funnel and conduit are supported from the sea's surface, preferably by a vessel such as a barge. The barge carries the equipment to receive the full flow of fluids from the well, to process the fluids, and to conduct the liquids to a nearby tanker where the recovered liquid hydrocarbons may be stored.

U.S. Pat. No. 4,405,258, issued on Sep. 20, 1983 to O'Rourke et al., describes a method for containing oil and/or gas within a blow-out cover dome. This method includes the steps of deploying a containment dome in shallow water near the location of the seabed where the containment dome is to be located. The containment dome has an upper expanded dome-like fluid impervious membrane, a fluid impervious hollow peripheral ring attached to the periphery of the membrane to provide a depending bag-like container, and discrete water drainage means within the bag-like container for connection to pump conduit means therefrom. Wet sand from the seabed is then pumped into the bag-like container. Water is then drained from the wet sand through the water drainage means so as to provide a body of drained sand disposed within the bag-like container and providing a hollow peripheral ring as a hollow peripheral torus acting as a self-supporting structure and as an anchor for the dome-like structural unit. The dome is then charged with a buoyant amount of air and the buoyed dome is floated out to the site where the dome is to be deployed. It is then submerged by controllably releasing the air while substantially simultaneously filling the dome with water, thereby sinking the dome until the lighter-than-water fluid is captured within the dome.

U.S. Pat. No. 4,828,024, issued on May 9, 1989 to J. R. Roche, describes a diverter system and blowout preventer. The system comprises a blowout preventer attached above a spool having a hydraulically-driven sleeve/piston. An outlet flow passage exists in the spool. This outlet flow passage can be connected to a vent line. The outlet flow passage is closed off by the sleeve wall when the spool piston is at rest. Hydraulic ports are connected above and below the blowout preventer annular piston and above and below the spool annular piston. The ports below the blowout preventer piston and above the spool piston are in fluid communication with each other. A hydraulic circuit is provided having two valves between a source of pressurized hydraulic fluid and a drain.

U.S. Pat. No. 5,984,012, issued on Nov. 16, 1999 to Wactor et al., provides an emergency recovery system for use in a subsea environment. This emergency recovery system has a casing that is open at each end with a shackle connected to one end of the casing with the opposite end of the shackle designed for connection to appropriate points on the main stack and lower marine riser package in any orientation. A flexible sling with a closed loop formed at each end is used with one of the closed loops releasably connected to the shackle and the end of the casing. The other end of the sling has a flotation member attached to the sling adjacent the closed loop. The sling is fan folded as it is lowered into the casing. The flotation member is shaped to fit inside the other end of the casing with the closed end loop of the sling protruding from the casing. The flotation member is constructed of synthetic foam and is sized to provide sufficient buoyancy to fully extend the sling when the release ring is released by a remotely operated vehicle in a subsea environment.

U.S. Pat. No. 7,165,619, issued on Jan. 23, 2007 to Fox et al., teaches a subsea intervention system that includes a BOP module and CT module. A tool positioning system is used for positioning a selected subsea tool stored within a rack with a tool axis in line with the BOP axis, while a marinized coiled string injector is moved by positioning system to an inactive position. Power to the subsea electric motors is supplied by an electrical line umbilical extending from the surface for powering the pumps. An injector is provided that includes a pressure compensator roller bearing and a pressure-compensated drive system case.

U.S. Pat. No. 7,597,811, issued on Oct. 6, 2009 to D. Usher, provides a method and apparatus for subsurface oil recovery using a submersible unit. The submersible vehicle is positioned above the bed of a diver supported on a platform above the pollutant. A wand at one end of a pipe evacuated by a centrifugal pump is manipulated to draw the pollutant to the surface for treatment or disposal.

U.S. Pat. No. 7,921,917, issued on Apr. 12, 2011 to Kotrla et al., shows a multi-deployable subsea stack system. This subsea stack system includes a lower marine riser package, a blowout preventer stack with a first ram blowout preventer, and an additional blowout preventer package releasably coupled to the blowout preventer stack and comprising a second ram blowout preventer. The subsea blowout preventer stack assembly can be deployed by coupling a drilling riser to the lower marine riser package that is releasably connected to the blowout preventer stack. The lower marine riser package and blowout preventer stack are then attached to a subsea wellhead and then landed on the additional blowout preventer package that is coupled to the subsea wellhead.

U.S. Patent Publication No. 2009/0095464, published on Apr. 16, 2009 to McGrath et al., provides a system and method for providing additional blowout preventer control redundancy. This system has backup or alternate fluid flow routes around malfunctioning BOP control components using a remotely-installed removable hydraulic hose connection. The backup fluid flow route sends pressure-regulated hydraulic fluid to a BOP operation via an isolation valve rigidly attached to the BOP, then to a hose connected to an intervention panel on the BOP, and finally through a valve that isolates the primary flow route and establishes a secondary flow route to allow continued operation.

U.S. Patent Publication No. 2009/0260829, published on Oct. 22, 2009 to D. J. Mathis, provides a subsea tree safety control system that limits the probability of failure on demand of a subsea test tree. A safety shut-in system is provided for actuating a safety valve of the subsea test tree. The safety shut-in system includes a surface control station positioned above a water surface connected via an umbilical to a subsea control system positioned below the water surface so as to actuate the safety valve.

U.S. Pat. No. 4,444,250, issued on Apr. 24, 1984 to Keithahn et al., teaches a flow diverter apparatus having a housing and a piston with an annular packer disposed therein. The diverter has passages in the piston and housing walls providing fluid communication between the borehole and a vent line. A valve in the vent line is opened before the packer of the apparatus is closed about a tubular member in the bore or completely closes the vertical flow path of the bore. This diverts pressurized borehole fluid away from the rig equipment and personnel.

U.S. Pat. No. 4,502,534, issued on Mar. 5, 1985 to Roche et al., describes a flow diverter for connection to a drilling conduit beneath a drilling rig floor for diverting pressurized well bore fluid in the conduit from the rig and sealing the annulus between a pipe or other object and the conduit or closing the vertical flow path of the conduit. The apparatus has a housing, and annular packing element and two pistons. The housing is provided with at least one outlet passage in the wall of its body. One of the two pistons acts as a sliding sleeve valve in cooperation with the housing wall for preventing fluid communication between the outlet passage and the interior of the housing when it is in a nonactuated or normal position and for allowing fluid communication when it is in an actuated or diverting position.

U.S. Pat. No. 4,646,844, issued on Mar. 3, 1987 to Roche et al., shows a diverter/BOP system and method for a bottom-supported offshore drilling rig. The system includes a fluid flow controller and at least two bases adapted for being alternatively removably secured to the controller. When the first base is in combination with the fluid flow controller, the system may be used only as a diverter and when the second base is used in combination with the fluid flow controller the system may be used only as a blowout preventer.

U.S. Pat. No. 5,323,860, issued on Jun. 28, 1994 to B. J. Watkins, describes an apparatus for connecting a diverter assembly to a blowout preventer stack. An upper tubular member is adapted to be connected to the diverter assembly to form a lower continuation of the lower end of its bore. A lower tubular member is adapted to be connected to the blowout preventer stack to form an upper continuation of the upper end of its bore. A tubular body extends between and is pivotally and sealably connected to the upper and lower tubular members to connect their bores.

It is an object of the present invention to provide a pre-installed flow diversion system that is available if well shut-and cannot be achieved.

It is another object of the present invention to provide a fluid flow diversion system that improves response time associated with the closure of the well.

It is another object the present invention to provide a fluid flow diversion system which diverts fluid flow from the wellhead to a location so as to prevent the adverse effects of the boiling associated with the release of high-pressure hydrocarbons.

It is another object of the present invention to provide a flow diversion system which facilitates the removal or recapture of hydrocarbons after they are released.

It is still another object of the present invention provide a fluid flow diversion system that is easy to use and relatively inexpensive.

It is a further object of the present invention provide a fluid flow diversion system which provides a fail-safe mechanism in combination with the blowout preventer so as to avoid the accidental release of hydrocarbons or the possibilities of a blowout associated with oil and gas production.

These and other objects and advantages of the present invention will become apparent from a reading of the attached specification and appended claims.

BRIEF SUMMARY OF THE INVENTION

The present invention is a system for the diversion of flow from a wellhead. The system comprises a mudline closure mechanism suitable for attachment to the wellhead. The mudline closure mechanism has a main passageway and a diversion passageway. A blowout preventer is connected or interconnected to the mudline closure mechanism. The blowout preventer has a flow passageway that communicates with the main passageway of the mudline closure mechanism. A flow control line has one end connected to the diversion passageway that extends therefrom such that an opposite end of the flow control line is disposed away from the mudline closure mechanism.

The mudline closure mechanism has a valve suitable for switching fluid from the main passageway to the diversion passageway. A riser has one end connected to the main passageway and an opposite end connected to the blowout preventer. The blowout preventer is, in the preferred embodiment of the present invention, disposed or positioned on a surface of the body of water above the mudline closure mechanism. The mudline closure mechanism is operable independently of the blowout preventer. The valve is in a normally open position. The valve is actuated so as to move to a flow diverting position.

In the present invention, a flexible riser is connected to the opposite end of the flow control line. The flexible riser extends to a surface of the body of water. A flare buoy is connected to the flexible riser at an end away from the opposite end of the flow control line. A plurality of mooring lines have one end affixed to the flare buoy. An opposite end of the plurality of mooring lines are anchored to the subsea floor. A containment boom can be positioned at the surface of the body of water. The flexible riser has an end opposite the opposite end of the flow control line that is positioned interior of a perimeter of the containment boom. A base is positioned away from the mudline closure mechanism. This base supports the opposite end of the flow control line. The flexible riser is connected to and in fluid communication with the flow control line. The base serves to support the flexible riser in relation to the floor of the body of water.

This foregoing Section is intended describe, with particularity, the preferred embodiment of the present invention. It is understood that modifications to this preferred embodiment can be made within the scope of the present invention. As such, this Section should not be construed as limiting, in any way, of the broad scope of the present invention. The present invention should only be limited by the following Claims and their legal equivalents.

DETAILED DESCRIPTION OF THE INVENTION

Figure 1:
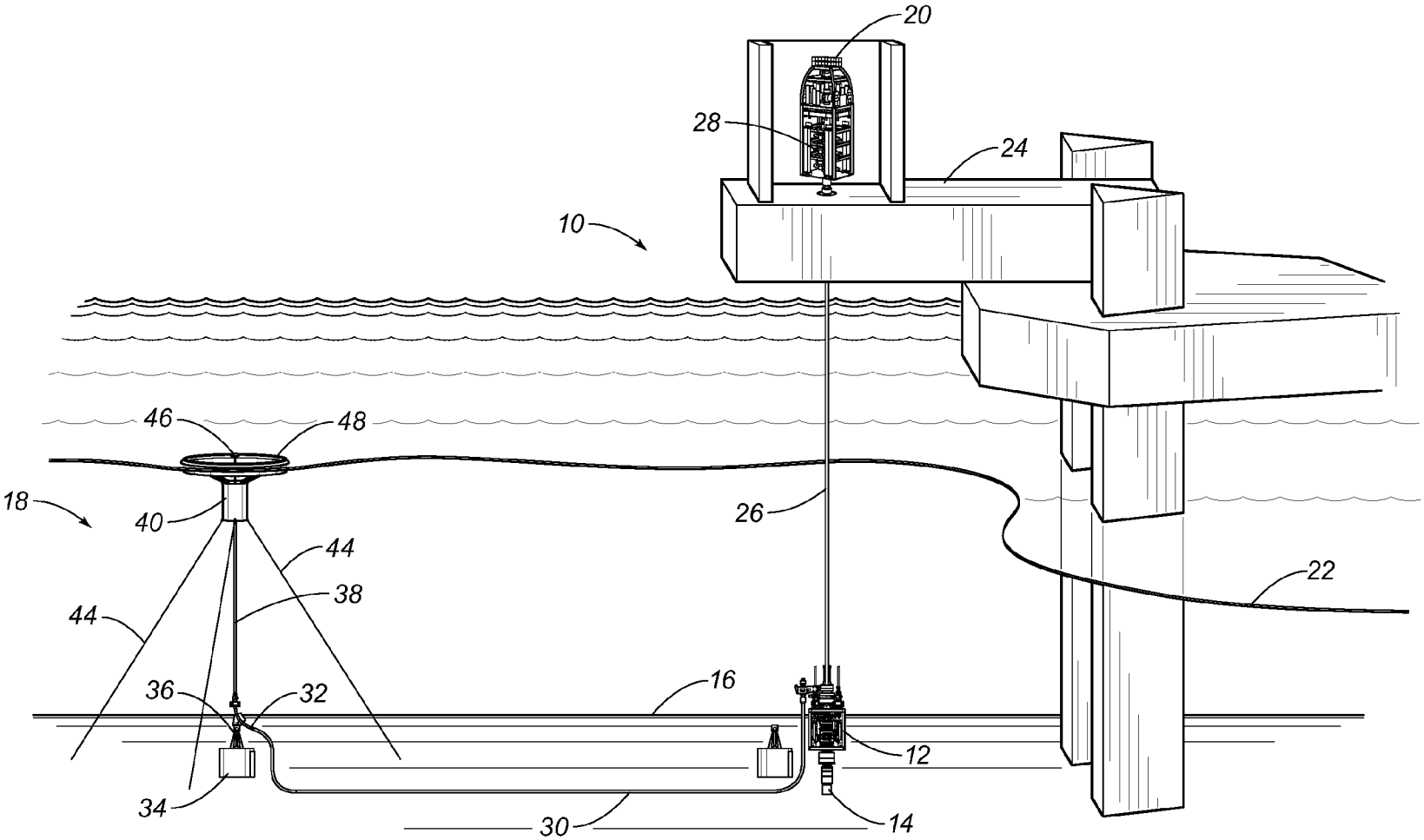
FIG. 1 is an illustration of the fluid flow diversion system of the present invention.

Referring to FIG. 1, there is shown the system 10 of the present invention for diverting the flow of fluid from a well. In particular, the system 10 of the present invention includes a mudline closure mechanism 12 that is affixed upon a wellhead 14 located at the floor 16 of a body of water 18. A blowout preventer 20 is positioned above the surface 22 of the body of water 18 and is illustrated as supported upon an offshore platform 24. A riser 26 extends from the flow passageway 28 of the blowout preventer 20 so as to communicate with the main passageway (to be shown hereinafter) of the mudline closure mechanism 12.

In the configuration shown in FIG. 1, normal drilling operations can occur. The riser 26 can be formed of a flexible tubular material. Alternatively, the riser 26 can be a high-pressure pipe. As such, tools can be introduced through the interior of the main passageway 28 of the blowout preventer 20 and through the riser 26 and through the main the main passageway of the mudline closure mechanism 12. As such, drilling, and other activities, can occur through the wellhead 14.

In FIG. 1, it can be seen that there is a flow control line 30 that is connected to a diversion passageway of the mudline control mechanism 12. The flow control line 30 extends from the diversion passageway for a distance so as to have an opposite end 32 located a significant distance away from the mudline closure mechanism 12 and from the offshore platform 24. So as to facilitate the destruction or recovery of the hydrocarbons that would pass through the flow control line 30, a base 34 is embedded in the floor 16. The base 34 provides a support 36 thereon which serves to receive the end 32 of the flow control line 30 opposite the mudline closure mechanism 12.

In normal operation, the placement of the end 32 of the flow control line 30 a significant distance away from the platform 24 will cause any release of hydrocarbons to flow upwardly therefrom. As such, the boiling action of the seawater is diverted away from any areas directly below the blowout preventer 20 or from the platform 24. As such, although a risk of fire and explosions can occur, any such fire or explosions will occur a significant distance away from the equipment that is required for the repair of the wellhead 14 or the blowout preventer 20. This distance can allow marine vessels to easily maneuver into the area so as to effectively control the well.

The hydrocarbons that are released from the end 32 of the flow control line 30 can be connected to a flexible riser 38. Flexible riser 38 is connected the end 32 so as to allow the hydrocarbons that are released from the end 32 to flow upwardly therefrom. A buoy 40 is illustrated as supported adjacent to the surface 22 of the body of water 18. Mooring lines 44 are provided so as to anchor the buoy 40 in a position directly above the base 34 and to the floor 16 of the body of water. Importantly, the buoy 40 can support a flare 46 in a position above the surface 22 of the body of water 18. As such, the flare 46 can be used so as to burn off the hydrocarbons that are released through the diversion passageway of the mudline closure mechanism 12. Also, or alternatively, a containment boom 48 is positioned around the outlet of the riser 38 so as to contain any hydrocarbons that may be released therefrom. As such, the recovery of the hydrocarbons can occur by containing the hydrocarbons within the boom 48.

Figure 2:
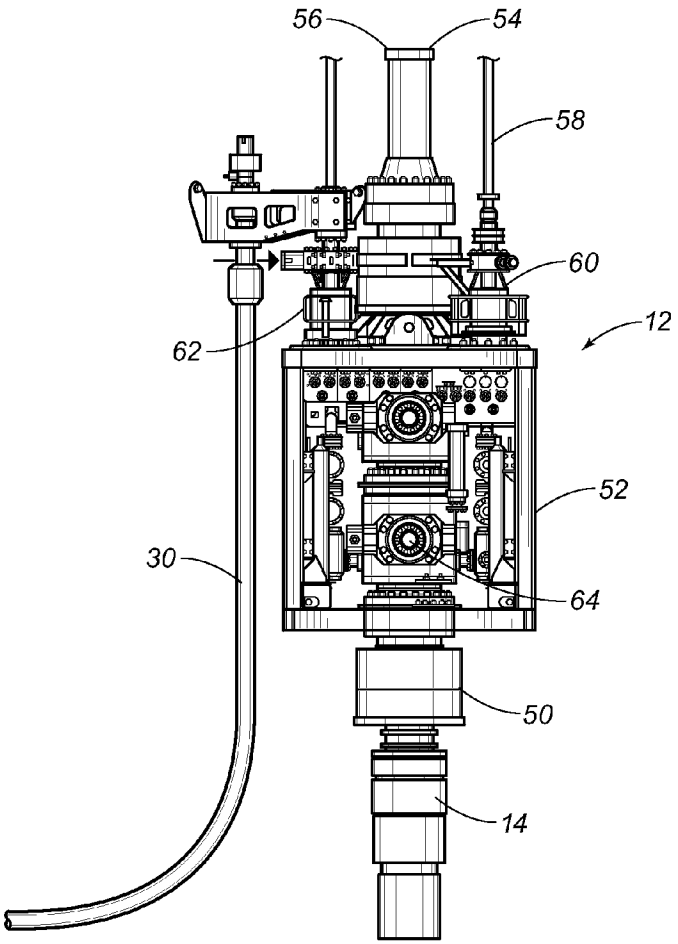
FIG. 2 is a side elevational view showing the mudline closure mechanism of the present invention.

FIG. 2 shows the mudline closure mechanism 12. In particular, the mudline closure mechanism 12 includes a connector 50 at a lower end thereof. Connector 50 is suitable for joining to the wellhead 14. A frame 52 extends around the components of the mudline closure mechanism 20. A main passageway will extend vertically through the interior of the mudline closure mechanism 12. As such, this main passageway 54 will extend from the wellhead 14 vertically through the interior of the mudline closure mechanism 12 and outwardly through the end 56 located at the top of the mudline closure mechanism. A fluid passageway 58 is provided so as to connect with a connector 60. Fluid line 58 can be in the nature of a choke-and-kill line. As such, line 58 allows fluids to be introduced into the main passageway 54. A diversion passageway 62 is also formed on the mudline closure mechanism 12. The diversion passageway 62 can communicate with a portion of the main passageway. A valve 64 is provided in a normally open position. As such, during normal use of the mudline closure mechanism 12, drilling and production activities can occur in a conventional fashion. In those circumstances where a problem exists with the blowout preventer 20 or with the riser 26, the valve 64 can be suitably switched such that flow is diverted from the main passageway 54 into the diversion passageway 62. The diversion passageway 62 is connected by suitable connectors to the flow control line 30.

It should be noted that the valve 64 can be remotely actuated through acoustics. As such, in the event of an emergency, a signal can be transmitted to an actuator of the valve 64 so as to control the valve in order to achieve the diversion of fluid flow. The fluid flow will then be blocked from passing through the main passageway 54 and into the riser 26. The flow is diverted along the diversion passageway 62 and into the fluid control line 30.

Figure 3:
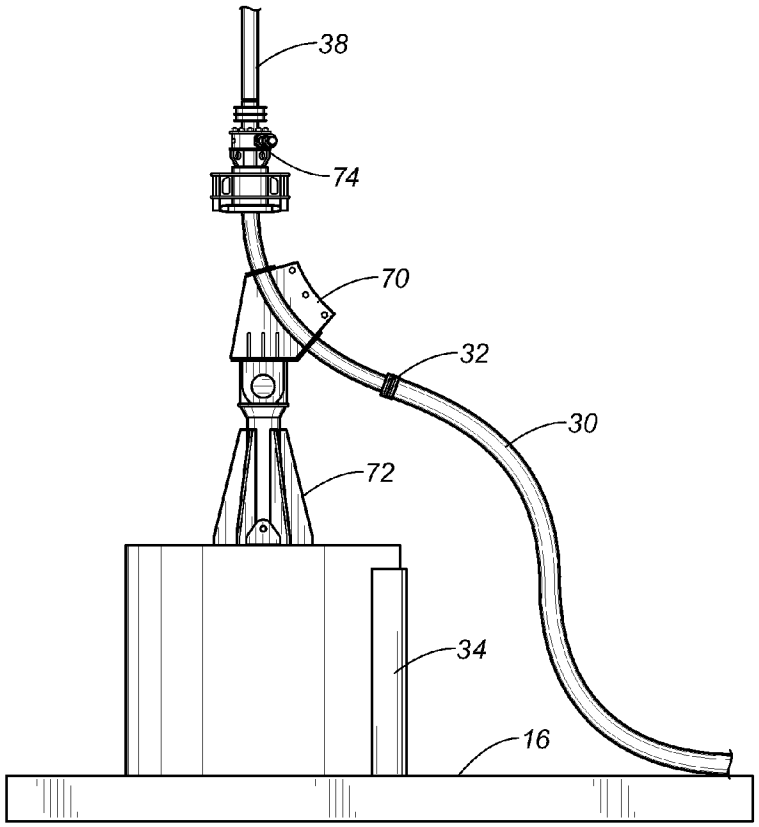
FIG. 3 is a side elevational view showing the base and its support of the flow control line and the flexible riser.

FIG. 3 shows the construction of the base 34. As can be seen, the end 32 of the flow control line 30 is connected to a support 70 extending upwardly from a pedestal 72 that extends from the top of the base 34. The base 34 will be embedded into the floor 16 of the subsea environment. A connector 74 can then be connected to the flexible riser 38. The connections between the flow control line 30 and the flexible riser 38 can be carried out through the use of remotely-operated vehicle (ROV).

In the configuration shown in FIG. 3, the flow control line 30 is maintained in a fixed position. As such, it is assured that the end 32 of the flow control line 30 is a significant distance away from the mudline closure mechanism 12 and from the blowout preventer 20. The base 34 supports the flexible riser 38 thereon such that the flexible riser 38 is directed upwardly in a desired path.

Figure 4:
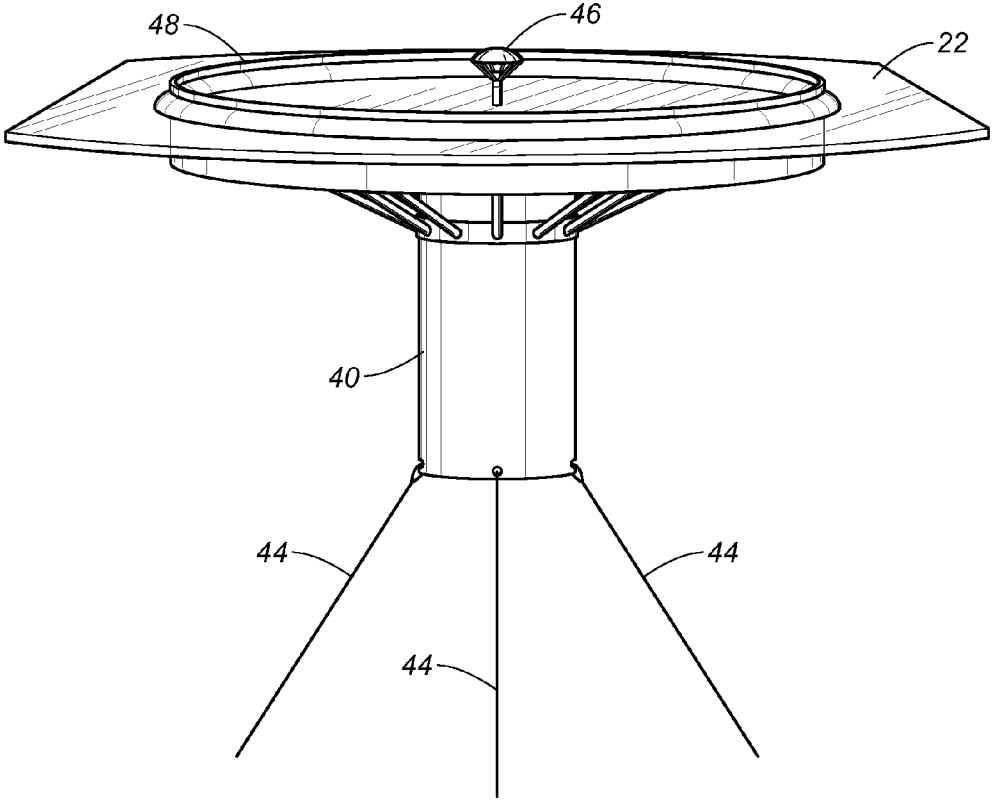
FIG. 4 is a perspective view showing the buoy having the flare thereon and the containment boom extending therearound in relation to the body of water.

FIG. 4 illustrates the buoy 40. It can be seen that the buoy 40 is secured to the floor 16 of the body of water through the use of mooring lines 44. The buoy 40 will support a flare 46 at an upper end thereof. The can be seen that the flare 46 is located above the surface 22 of the body of water. As such, the flare 46 can be utilized so as to burn off hydrocarbons that may pass through the flexible riser 38. A circular containment boom 48 surrounds the flare 46 at in the outlet of the flexible riser 38. Containment boom 48 will float on the surface 22 of the body of water. As such, any hydrocarbons that are not burned by the flare 46 can be contained within the containment boom 48 for capture and recovery.

Figure 5:
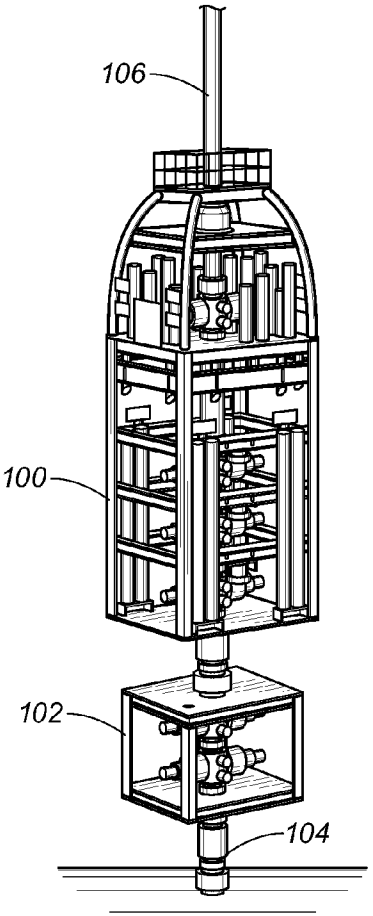
FIG. 5 is a perspective view of an alternative embodiment of the flow diversion system of the present invention.

FIG. 5 shows an alternative embodiment of the present invention. In FIG. 5, can be seen that the blowout preventer 100 is directly affixed to a top of the mudline closure mechanism 102. The blowout preventer 100 is installed subsea. As such, the mudline closure mechanism 102 will be interposed between the wellhead 104 and the blowout preventer 100.

In the embodiment shown in FIG. 5, the mudline closure mechanism 102 provides redundancy to the structure of the blowout preventer 100. In other words, and under most circumstances, the valve of the mudline control mechanism 102 will remain open so that the main passageway of the mudline control mechanism 102 is aligned with the flow passageway 106 of the blowout preventer 100. Under virtually all circumstances, the blowout preventer 100 will effectively control the flow of hydrocarbons from the wellhead 104. It is only under those circumstances where there is a major failure in the blowout preventer 100 that it is necessary to utilize the mudline closure mechanism 102. As such, if one or more of the rams associated with the blowout preventer 100 should fail, the flow of fluid will continue through the main flow passageway 106. The present invention allows the actuator associated with the valve of the mudline closure mechanism 102 to close the valve associated therewith into divert the flow into the flow control line 30 (in the manner described in the preferred embodiment of the present invention). Once again, the embodiment shown in FIG. 3 assures that the boiling effects associated with the high pressure release of hydrocarbons is diverted a significant distance away from the blowout preventer 100. As such, the boiling action of the hydrocarbons will not adversely affect the ability to repair or replace the blowout preventer 100. If a repair of the blowout preventer it requires the removal of the blowout preventer 100, then the mudline closure mechanism 102 can remain in place so that the fluid flow can be diverted away from the area of the blowout preventer 100. As such, removal and installation can occur without the problems associated with the release of hydrocarbons in the area of the repair or replacement.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A system for diversion of a fluid flow from a subsea wellhead, the system comprising:

a mudline closure mechanism suitable for attachment to the wellhead, said mudline closure mechanism having a main passageway and a diversion passageway, said mudline closure mechanism having a valve therein;

a blowout preventer connected or interconnected to said mudline closure mechanism, said blowout preventer having a flow passageway communicating with said main passageway of said mudline closure mechanism, said blowout preventer positioned on a surface of a body of water above said mudline closure mechanism, said mudline closure mechanism operable independently of said blowout preventer;

a riser having one end connected to said main passageway and an opposite end connected to said blowout preventer, said valve being in a normally open position so as to allow fluid flow from said main passageway of said mudline closure mechanism through said riser to said blowout preventer;

a flow control line having one end connected to said diversion passageway and extending therefrom such that an opposite end of said flow control line is disposed away from said mudline closure mechanism, said valve being actuable so as to move to a flow diverting position such that fluid flow is diverted away from said riser to said diversion passageway and to said flow control line;

a base positioned away from said mudline closure mechanism, said base supporting said opposite end of said flow control line;

a flexible riser connected to and in fluid communication with said flow control line, said flexible riser being supported by said base, said flexible riser having an end opposite said base surface for passing the diverted fluid to the water at the surface of the body of water in a location away from said blowout preventer.

2. The system of claim 1, further comprising:

a flare buoy connected to said end of said flexible riser away from said opposite end of said flow control line.

3. The system of claim 2, further comprising:

a plurality of mooring lines having one end affixed to said flare buoy, said plurality of mooring lines having an opposite end anchored to the subsea floor.

4. The system of claim 1, further comprising:

a containment boom positioned at the surface of the body of water, said end of said flexible riser positioned interior of a perimeter of said containment boom.

5. A system for diversion of a flow of a fluid from a wellhead at a subsea floor, the system comprising:

a mudline closure mechanism suitable for attachment to the wellhead, said mudline closure mechanism having a main passageway and a diversion passageway, said mudline closure mechanism having a valve for switching the flow of fluid from said main passageway to said diversion passageway;

a flow control line having one end affixed to said diversion passageway and extending outwardly therefrom so as to have an opposite end positioned away from said mudline closure mechanism;

a base adapted to be anchored to the subsea floor, said opposite end of said flow control lines supported by said base; and a flexible riser having one end connected to said opposite end of said flow control line and extending upwardly therefrom, said flexible riser having an opposite end directed toward a surface of the body of water in a location substantially spaced from the surface of the body of water directly above the wellhead so as to discharge the fluid into the water.

6. The system of claim 5, further comprising:

a blowout preventer having a flow passageway communicating with said main passageway of said mudline closure mechanism, said blowout preventer positioned above said mudline closure mechanism.

7. The system of claim 6, further comprising:

a riser having one end connected to said main passageway of said mudline closure mechanism and an opposite end connected to said flow passageway of said blowout preventer.

8. The system of claim 6, said mudline closure mechanism operable independently of said blowout preventer.

9. The system of claim 6, said valve being in a normally open position such that said main passageway of said mudline closure mechanism is in fluid communication with said flow passageway of a blowout preventer, said valve being actuatable so as to divert fluid flow from said main passageway to said diversion passageway.

10. The system of claim 5, further comprising:

a flare connected to said opposite end of said flexible riser, said flare suitable for extending above the surface of the body of water.

11. The system of claim 5, further comprising:

a buoy connected to said opposite end of said flexible riser, said buoy buoyantly supporting said opposite end of said flexible riser at the surface of the body of water.

12. The system of claim 11, further comprising:

a plurality of mooring lines having one and affixed to said buoy, said plurality of mooring lines having an opposite end anchored to a subsea floor.

13. The system of claim 5, further comprising:

a containment boom positioned at the surface of the body of water, said opposite end of said flexible riser positioned within an interior of said containment boom.

* * * * *